United States Patent [19]

Schmid

[11] Patent Number: 5,059,078

[45] Date of Patent: Oct. 22, 1991

[54] APPARATUS FOR THE COMBING-IN AND BINDING OF PUNCHED SHEETS

[75] Inventor: Dagobert Schmid, Horn, Fed. Rep. of Germany

[73] Assignee: Chr. Renz GmbH & Co., Heubach, Fed. Rep. of Germany

[21] Appl. No.: 626,098

[22] Filed: Dec. 11, 1990

[30] Foreign Application Priority Data

Dec. 16, 1989 [DE] Fed. Rep. of Germany ..... 3941648

[51] Int. Cl.[5] ..... B42B 5/10

[52] U.S. Cl. ..... 412/39; 412/40

[58] Field of Search ..... 412/33, 38, 39, 40

[56] References Cited

U.S. PATENT DOCUMENTS 4,758,125 7/1988 Wahl ..... 412/39

4,934,890 6/1990 Flatt ..... 412/39

FOREIGN PATENT DOCUMENTS 2121724 1/1984 United Kingdom ..... 412/39

*Primary Examiner*—Paul A. Bell

*Attorney, Agent, or Firm*—Jenner & Block

[57] ABSTRACT

An apparatus for the combing-in and binding of punched single sheets into a prefabricated wire comb having a multiplicity of teeth bent into circles and connected to one another, which are inserted into punched-out holes in the sheets, where the apparatus includes a closing device having a movable closing beam with a counter-pressure plate for bending the prefabricated wire comb into a circular shape. Retaining elements are arranged on the counter-pressure plate or a part connected to the counter-pressure plate, which position at least a part of the teeth of the wire comb. The counter-pressure plate is slidable under the closing beam with the retaining elements positioned such that the single sheets are inserted into the wire comb for binding.

29 Claims, 2 Drawing Sheets

APPARATUS FOR THE COMBING-IN AND BINDING OF PUNCHED SHEETS

TECHNICAL FIELD

The invention relates to an apparatus for the combing and binding of punched sheets in a pre-fabricated wire comb comprised of a multiplicity of coils bent into circles and interconnected, which are inserted into punched holes in the sheets.

BACKGROUND OF THE INVENTION

With apparatuses of this kind sheets are bound in a book-like manner into brochures, catalogs, calendars, instructions for use, operating manuals, etc., in a so-called ring binder.

Typically, after the holes have been punched into the sheets, the sheets are placed manually into the pre-fabricated wire comb in the desired order. The wire comb has at that stage not yet been bent into its final circular shape for this purpose, but is still open at the top, so that the coils of the wire comb can be placed in the punched-out holes of the sheets. When all the sheets have been properly inserted, the wire comb is laid manually under the closing beam of the apparatus. Following this the closing beam is pushed down by actuation of a lever, whereby the wire comb is clamped between the closing beam and the counter-pressure plate. During the closing movement directed further downward the wire comb rolls itself in an appropriate manner and forms the closed circular shape, so that the sheets are bound.

What is tedious and time-consuming during such a binding operation, however, is the insertion or combing of the sheets into the coils. If the sheets are inserted into the coils by hand, this requires the proper skill. Afterwards great care must be taken with the wire comb and the sheets placed in it, especially when inserting it below the closing beam, in order that the beam does not slip out of the coils of the wire comb again. When a ring book that is to be provided with a suspension device is bound, such as, for example, a calendar, the suspension device must in addition be tediously threaded into the wire comb under the closing beam immediately before the binding operation.

A simplified arrangement can be used where a prefabricated wire comb is clamped under a magnetic rail, with which the wire comb is at least held tight, thus making insertion of the sheets with two hands easier. One disadvantage of this approach, however, is that after careful insertion of the wire comb, which is still open, it must be transported to the closing beam by hand.

SUMMARY OF THE INVENTION

The present invention is therefore based on the premise of improving an apparatus of the type mentioned above in such a way that it becomes easier to handle, especially one with which combing and binding can be carried out faster and with fewer problems.

One object of the invention is to solve this problem by arranging retaining elements on the counter-pressure plate, which position at least a part of the coils of the wire comb, and where the counter-pressure plate with the retaining elements are adjustable from a position from which the sheets are inserted into the wire comb under the closing beam for binding.

By means of the retaining elements according to the invention the wire comb is held tight for combing of the sheets so that the operator has both hands free for the combing operation. During the combing operation the wire comb is held securely by the retaining elements. Through adjustability (according to the invention) of the counter-pressure plate in the stated manner, an additional operation is then avoided, and one of the main advantages is that this prevents sheets from slipping out of the wire comb, which is still open.

A further advantage of this is that any suspension device can be inserted into the wire comb after combing and before positioning under the closing beam, and more precisely without it slipping out again or shifting during transport by hand—as was formerly the case.

Through the simplification according to the invention this is now also suitable for office purposes, because until now such bound ring books were generally produced only in printing shops, at bookbinders, etc., since their handling required the appropriate skill and practice.

A simple embodiment of the retaining elements would be for them to have pins projecting upward from the counter-pressure plate.

The upper ends can also serve in a simple way as hold-down elements for the teeth of the wire comb, with which the wire comb is positioned even more securely.

The counter-pressure plate can be adjusted as desired in different ways. In general, a simple sliding guide in the housing of the apparatus is sufficient.

The counter-pressure plate can be adjusted in a simple way by pushing it appropriately by hand. Actuation by a lever apparatus is, however, also possible.

If the counter-pressure plate is moved by hand in a simple way, then it is an advantage if gripping recesses are provided in the contact surface of the counter-pressure plate or a plate is connected to it, so that, on gripping the sheets combed into the wire comb, it is possible to grip under the first sheet with one or more fingers and the entire unit can be shifted more easily.

It is an advantage if provision is made for the counter-pressure plate to be slidable against the force of a return spring in the direction of the closing beam. In this way the bound ring book is again pulled back into the initial position automatically on termination of the binding operation, and can thus be taken out in an easy manner, whereafter the next combing operation can be performed after a renewed insertion of a pre-manufactured wire comb.

A return spring unit can be created in very different ways. A simple manner is to make provision for the return spring unit to have at least one spring, one end of which is fastened to the counter-pressure plate or to a part connected to it, and the other end to a fixed part of the housing.

It is an advantage if provision is made for the retaining elements to be vertically adjustable.

In this way wire combs with different diameters can be simply used in the same apparatus.

Vertical adjustability can be accomplished in a multiplicity of ways, care generally being taken that all retaining elements are as far as possible accordingly adjusted in the vertical direction in one single operation or with few manipulations.

In a further embodiment of the invention, provision can be made for the rear plate of the closing beam to have recesses into which the hold-down elements of the pins can be slid.

To be able also to use wire comb bindings with small diameters well, it may be necessary to bring the retaining elements as close as possible to the rear plate of the closing beam so as to prevent single sheets from slipping out. If corresponding recesses are then provided in the rear plate, when required the parts of the hold-down elements bent round towards the rear can be slid in a non-disturbing manner even as far as the recesses, in which way the retaining elements can be brought as close as possible to the rear plate.

In practice, a spacing between the retaining elements of one inch has proven to be the most advantageous distance, because in this way the apparatus according to the invention can be used for the binding of the three pitches generally used, that is, 4:1, 3:1 and 2:1—related to a one inch pitch.

It goes without saying that, when needed, however, it is also possible to make the distances between the retaining elements adjustable.

DETAILED DESCRIPTION OF THE DRAWINGS

Figure 1:
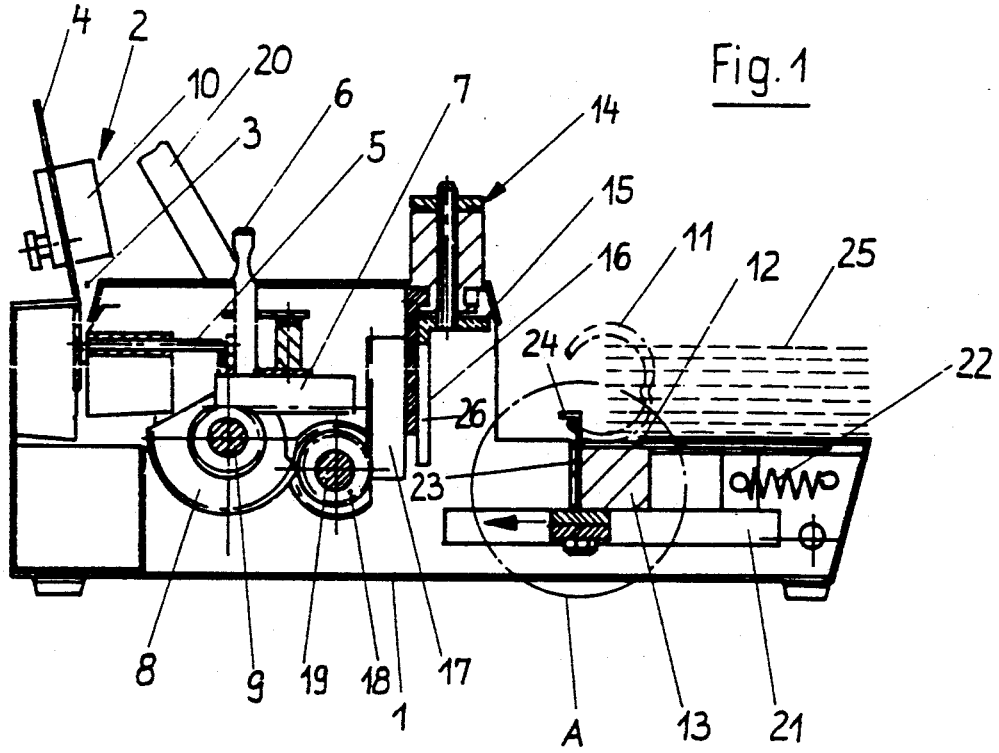
FIG. 1 is a longitudinal section through the apparatus according to the invention in initial position.

The apparatus according to the invention is basically of a well-known type, which is why only the parts important to the invention are dealt with in greater detail in the following paragraphs.

In a housing 1 a punching apparatus 2 is arranged in the rear section, in which punching apparatus the individual sheets are laid in a slot 3 for punching out the holes, where they rest on a rear wall 4. By means of a suitable number of punching stamps 5, which are actuated via pressure pieces 6, the corresponding openings or holes are punched into the single sheets. The pressure pieces 6 are pushed appropriately back and forth horizontally by means of a toothed-wheel apparatus 7 and a toothed-wheel gear unit 8 working together with it, whose shaft 9 is actuated via a lever. For precise positioning of the single sheets to be perforated there is a stop 10.

In the front area of the housing there is a threading and closing apparatus. For treading of the perforated single sheets in a desired order, a wire comb 11 that is still open is placed on a supporting surface 12 which is connected to a counter-pressure plate 13. The supporting plate 12 is slidable in horizontal direction together with the counter-pressure plate 13 in a guide (not shown in greater detail) in the housing 1. In the central area of the apparatus there is a closing unit 14, which has a closing beam 15, which is slidable in vertical direction. The closing beam 15 is slid together with a vertical rear plate 16 through a rear rack 17 and a gear unit 18 working together with it. The adjusting shaft 19 of the gear unit 18 is actuated by a lever 20.

One end of a spring unit 22 is fastened to the counter-pressure plate 13 or a sliding plate 21 connected to it, whereas the other end of the spring is secured to the housing 1.

A multiplicity of retaining elements in the form of pins 23 are pushed from below by the counter-pressure plate 13 through corresponding holes in the counter-pressure plate 13. The pins 23 are located beside one another spaced one inch apart. On the top side the pins 23 project upwards over the supporting surface and are angled off at their upper ends backwards in horizontal direction, thus forming hold-down elements 24.

The apparatus according to the invention functions in the following way:

For insertion of the single sheets previously provided with the appropriate holes in the punching unit 2 the apparatus is located in the position shown in FIG. 1.

In that position single sheets 25 (see illustration in broken lines) are inserted into the wire comb, which is still open, which is provided in the usual way with a multiplicity of teeth that are stuck through the holes of the single sheets. The wire comb 11, which is appropriately positioned beforehand, is then held by the retaining elements 23, with the hold-down elements 24 securing the bottom teeth of the wire comb 11, which both permits a positioning of the wire comb 11 and also prevents the wire comb from twisting. In this way the single sheets 25 can be inserted from above and combed in. The wire comb 11 is positioned securely by the pins 23 and the hold-down elements 24. This means that despite the still open ring, suspension devices, such as, for example, a piece of wire for a calendar, can also be inserted.

Figure 2:
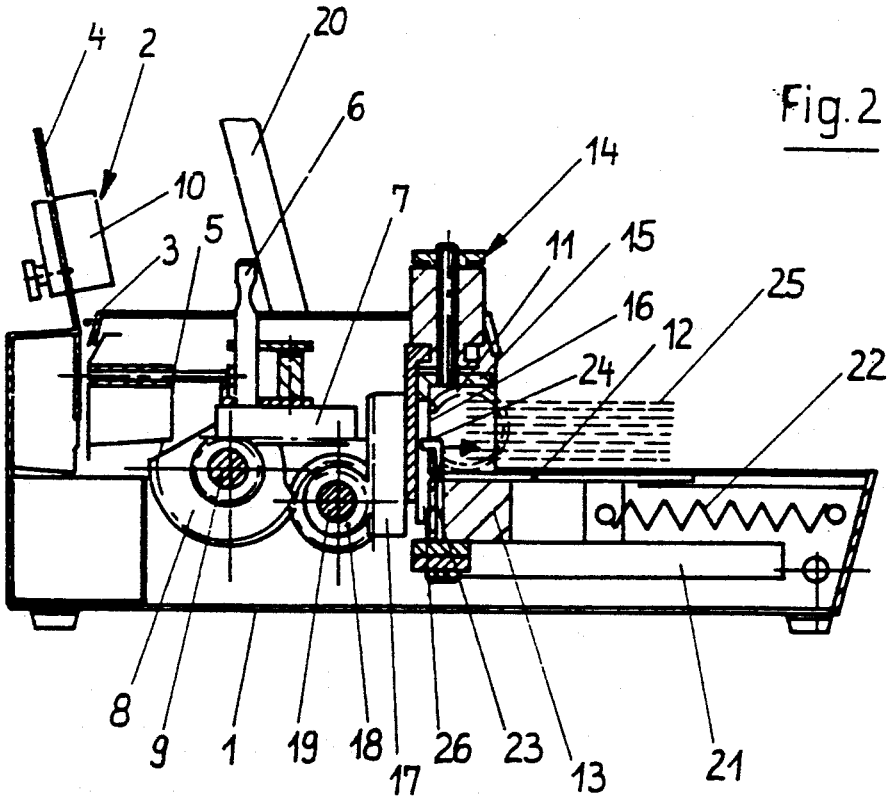
FIG. 2 is a longitudinal section corresponding to the section after FIG. 1 in closing position of the wire comb.

When the single sheets have been completely inserted, the counter-pressure plate is slid together with the supporting surface 12 and the sliding plate 21 in the direction of the arrow in FIG. 1 horizontally until the counter-pressure plate 13 comes to rest under the closing beam 15 (see FIG. 2). When this happens, the lever 20 is actuated and, by means of the gear unit 18 and the gear rack 17, the closing beam 15 is moved downward together with the rear plate 16. During this movement directed downward the wire comb 11 is rolled in until a closed ring has been formed, which terminates the ring binding.

On termination of the closing operation the lever movement is reversed and the closing beam is again moved upward. Because of the spring force of the spring tension that has taken place during the sliding operation of the supporting surface 12 with the counter-pressure plate 13, the unit, consisting of supporting surface 12, counter-pressure plate 13 and sliding plate 21, is again pulled back into the initial position (in the drawing toward the right). In this way the finished ring book can be taken out and inserted into a new, open wire comb 11 and be held firmly by the retaining elements 23.

Figure 3:
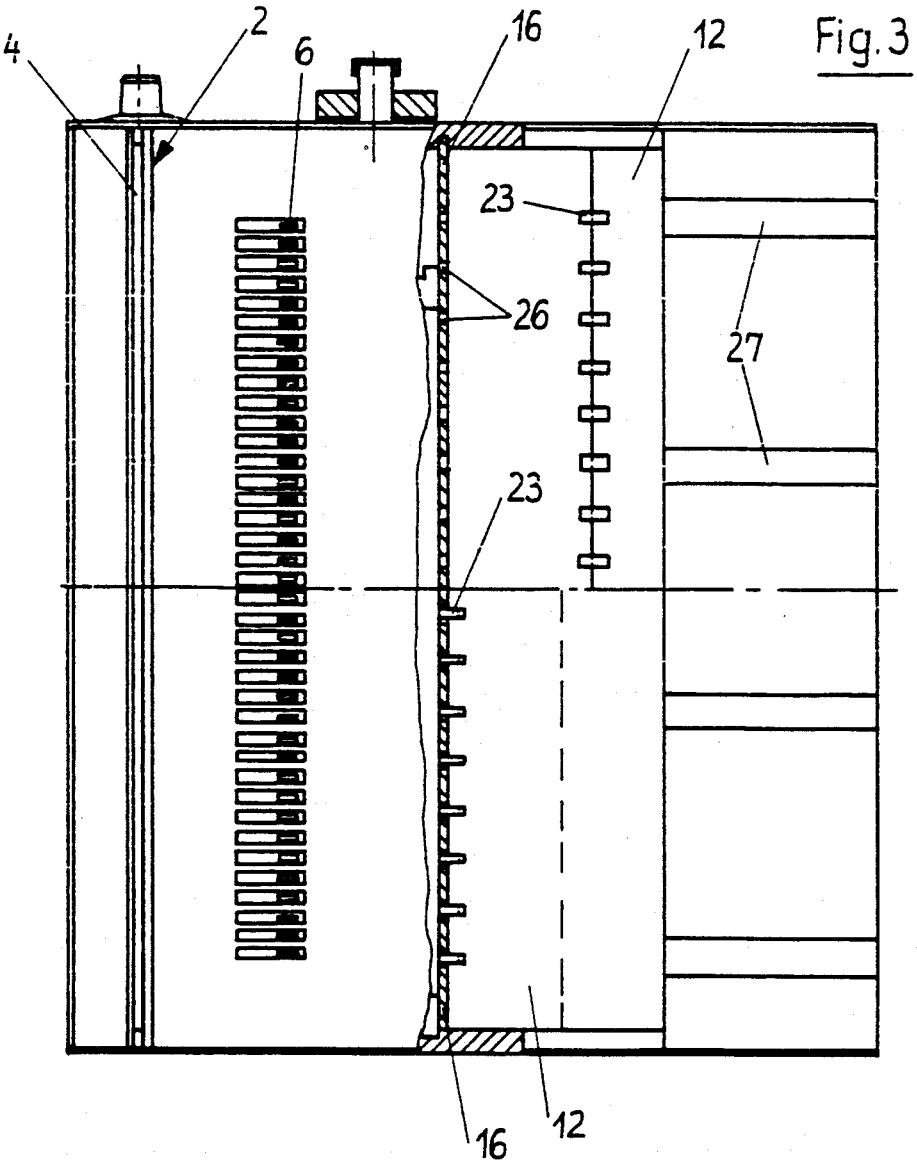
FIG. 3 is a plan view of the apparatus.

As can be seen from FIG. 1 and the top half of FIG. 3, the rear plate 16 has vertical recesses 26, which are arranged so that they are flush with the pins 23 and the hold-down elements 24. As can be seen from FIG. 2 and the bottom half of FIG. 3, in this way it is possible to run the counter-pressure plate 13 as close as possible to the rear plate 16, whereby the horizontal parts of the hold-down elements 24 can be pushed into the recesses of the rear plate 16.

The shifting of the slidable unit can be done by hand by simply pushing the package of single sheets 2 correspondingly horizontally toward the left (per FIG. 1), whereupon the supporting surface 12, the counter-pressure plate 13 and the sliding plate 21 are shifted accordingly by friction. For this purpose grip depressions (see FIG. 3) are, if required, provided in the supporting surface 12 so that it is easier to grip underneath with the fingers and thus ensures that all sheets are also carried along and the sliding operation can be performed perfectly.

It goes without saying that the sliding can also be performed by lever actuation or by actuation grips (not shown) projecting upward out of the supporting surface 12.

In order also to perfectly secure wire combs of different diameters without problems, especially very small and also very large wire combs 11, the pins 23 can be vertically adjustable in such a way that their height projecting above the supporting surface 12 is adjustable so that the hold-down elements 24 can always hold the teeth of the wire comb firmly to prevent the wire comb from twisting.

Figure 5:
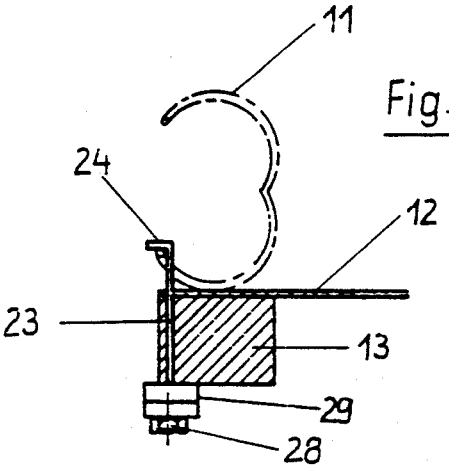
FIGS. 4 and 5 are enlarged sectional views of the retaining elements per Extract A of FIG. 1.
Figure 4:
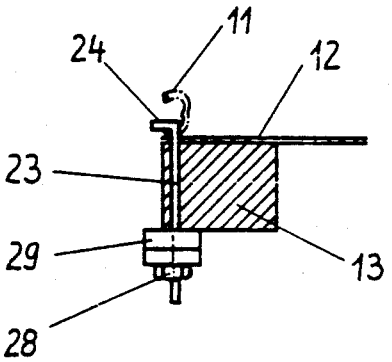

A vertical adjustment unit is, for example, shown in FIGS. 4 and 5, with FIG. 4 showing the positioning of a pin for a very small wire comb 11, while FIG. 5 shows the positioning of a very large wire comb 11. For vertical adjustment the pins 23 have a thread in the rear or bottom area, onto which an adjusting nut 28 is screwed. Between the adjusting nut 28 and the underside of the counter-pressure plate 13, spacers 29 may be arranged, which may also have differing thicknesses corresponding to the desired height.

In the case of wire combs with a fairly small diameter it may happen that on the closing movement, i.e. on rolling-in of the wire comb, the retaining elements 23 and the hold-down elements 24 cannot always perfectly slop out of the teeth of the wire comb again. For this reason it is an advantage if the retaining elements or pins 23 are bent back slightly (see arrow in FIG. 2) for such cases during the downward directed movement of the closing beam 15, i.e. on roll-in of the wire comb 11, so that they are freed from the teeth of the wire comb.

This bending-back, i.e. the removal of the pins from the rear plate 16, can be coordinated, for example, with the closing movement of the closing beam 15 so that no special actuation is required for bending back the pins 23. One possibility for this may, for example, consist in that the pins are manufactured from a punched part, with the pins projecting out of a punched base plate. If a wedge, for example, is then pushed in during the downward directed movement of the closing beam 15 likewise from above between the rear plate 16 and the pins 23 or the base plate, on which the pins are arranged, the pins are forcibly bent away. Care should then only be taken that the pins have sufficient inherent elasticity so that they can subsequently spring back again. It goes without saying that the pins 23 are instead also pushed back a small distance in a simple way by hand or by a mechanical movement in the direction of the initial position.

I claim:

1. An apparatus for the combing-in and binding of a plurality of punched single sheets into a prefabricated wire comb which includes a multiplicity of teeth bent into circles which are inserted into holes in the sheets, comprising: a movable closing beam cooperating with a counter-pressure plate for bending the prefabricated wire comb into the circular shape; a plurality of retaining elements disposed to said counter-pressure plate such that said retaining elements position the teeth of the wire comb; and wherein said counter-pressure plate with said retaining elements are slidable under said closing beam from a position from which the single sheets are inserted into the wire comb for binding.

2. The apparatus according to claim 1 wherein said retaining elements include pins projecting upward from said counter-pressure plate.

3. The apparatus of claim 2 wherein the counter-pressure plate includes a horizontal supporting surface slidable in a slide guide configured in a housing.

4. The apparatus of claim 2 including lever means for sliding said counter-pressure plate.

5. The apparatus of claim 2 wherein said counter-pressure plate is biased by a return spring unit in the direction of the closing beam.

6. The apparatus of claim 2 wherein said retaining elements are vertically adjustable.

7. The apparatus according to claim 2 wherein said retaining elements are arranged in a substantially one inch from one another.

8. The apparatus according to claim 2 wherein the upper ends of said retaining elements are effective to serve as hold-down elements for the teeth of the wire comb.

9. The apparatus according to claim 8, wherein said closing beam includes a rear plate having recesses into which a plurality of pins are inserted.

10. The apparatus of claim 8 wherein the counter-pressure plate includes a horizontal supporting surface slidable in a slide guide configured in a housing.

11. The apparatus according to claim 1 wherein the counter-pressure plate includes a horizontal supporting surface slidable in a slide guide configured in a housing.

12. The apparatus of claim 11 wherein said retaining elements are vertically adjustable.

13. The apparatus according to claim 11 wherein said retaining elements are arranged in a substantially one inch from one another.

14. The apparatus according to claim 11 wherein said supporting surface of said counter-pressure plate is configured with grip depressions.

15. The apparatus of claim 11 including lever means for sliding said counter-pressure plate.

16. The apparatus of claim 11 wherein said counter-pressure plate is biased by a return spring unit in the direction of the closing beam.

17. The apparatus according to claim 1 including lever means for sliding said counter-pressure plate.

18. The apparatus of claim 17 wherein said counter-pressure plate is biased by a return spring unit in the direction of the closing beam.

19. The apparatus of claim 17 wherein said retaining elements are vertically adjustable.

20. The apparatus according to claim 1 wherein the counter-pressure plate is biased by a return spring unit in the direction of the closing beam.

21. The apparatus according to claim 20, wherein said return spring unit includes at least one spring, one end of which is fastened to said counter-pressure plate and the other end to a housing.

22. The apparatus according to claim 21 wherein said retaining elements are vertically adjustable.

23. The apparatus according to claim 22 wherein said retaining elements are arranged in a substantially one inch from one another.

24. The apparatus according to claim 1 wherein said retaining elements are vertically adjustable.

25. The apparatus according to claim 24, wherein said retaining elements are inserted through vertical holes configured in said counter-pressure plate and are vertically adjustable by a screw arrangement.

26. The apparatus according to claim 25, wherein said retaining elements are threaded at least on their lower portion.

27. The apparatus according to claim 1 wherein said retaining elements are arranged in a substantially one inch from one another.

28. The apparatus according to claim 1 including means for adjusting the horizontal distances of said retaining elements.

29. The apparatus according to claim 1 including means for moving said retaining elements away from the teeth of the wire comb during a closing movement.

* * * * *

UNITED STATES PATENT AND TRADEMARK OFFICE

CERTIFICATE OF CORRECTION

PATENT NO. : 5,059,078

DATED : October 22, 1991

INVENTOR(S) : Dagobert Schmid

It is certified that error appears in the above-identified patent and that said Letters Patent is hereby corrected as shown below:

Column 4, line 61, change "2" to -- 25 --

Signed and Sealed this

Twenty-seventh Day of April, 1993

*Attest:*

MICHAEL K. KIRK

*Attesting Officer*

*Acting Commissioner of Patents and Trademarks*